US009271548B2

(12) United States Patent
Keyaki et al.

(10) Patent No.: US 9,271,548 B2
(45) Date of Patent: Mar. 1, 2016

(54) SLIDER FOR SLIDER FASTENERS

(75) Inventors: Keiichi Keyaki, Toyama (JP); Yohei Miyazaki, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/126,970

(22) PCT Filed: Jun. 17, 2011

(86) PCT No.: PCT/JP2011/063979
§ 371 (c)(1),
(2), (4) Date: Dec. 17, 2013

(87) PCT Pub. No.: WO2012/172692
PCT Pub. Date: Dec. 20, 2012

(65) Prior Publication Data

US 2014/0130315 A1 May 15, 2014

(51) Int. Cl.
*A44B 19/30* (2006.01)
*A44B 19/24* (2006.01)
*A44B 19/26* (2006.01)

(52) U.S. Cl.
CPC ..... *A44B 19/26* (2013.01); *A44B 19/262* (2013.01); *A44B 19/306* (2013.01); *Y10T 24/45157* (2015.01)

(58) Field of Classification Search
CPC . A44B 19/306; A44B 19/303; Y10T 24/2571
USPC ..... 24/418, 420, 421, 423, 424, 425, 585.1
See application file for complete search history.

(56) References Cited

U.S. PATENT DOCUMENTS

| | | | | | |
|---|---|---|---|---|---|
| 2,599,536 | A | * | 6/1952 | Backer | 24/421 |
| 2,657,445 | A | * | 11/1953 | Weber | 24/421 |
| 3,068,542 | A | * | 12/1962 | Firing | 24/421 |
| 3,133,328 | A | * | 5/1964 | Huelster | 24/421 |
| 3,287,780 | A | * | 11/1966 | Cooperberg | 24/421 |
| 4,644,613 | A | * | 2/1987 | Kedzierski | 24/421 |
| 4,662,036 | A | * | 5/1987 | Frohlich | 24/421 |

(Continued)

FOREIGN PATENT DOCUMENTS

| | | | |
|---|---|---|---|
| CN | 1143639 | C | 3/2004 |
| CN | 2909903 | Y | 6/2007 |

(Continued)

OTHER PUBLICATIONS

International Search Report, PCT Application No. PCT/JP2011/063979, mailed Aug. 16, 2011.

(Continued)

*Primary Examiner* — Robert J Sandy
*Assistant Examiner* — Jason W San
(74) *Attorney, Agent, or Firm* — Kilpatrick Townsend & Stockton LLP

(57) ABSTRACT

Provided is a slider for slide fastener. A pull-tab has a cam portion, and when the pull-tab is rotated from a laid-down state where the pull-tab is laid down toward one side of a slider main body to an erected state, the pull-tab is urged with using the cam portion in a direction in which the pull-tab reruns to the laid-down state by an elastic force of a spring part. The slider has a restraining part configured to prevent the pull-tab from rotating further from the erected state and prevent the pull-tab from being laid down toward the other side of the slider main body.

8 Claims, 15 Drawing Sheets

(56) References Cited

U.S. PATENT DOCUMENTS

| | | | | |
|---|---|---|---|---|
| 5,031,286 | A * | 7/1991 | Kedzierski | 24/421 |
| 5,152,036 | A | 10/1992 | Oda et al. | |
| 5,924,174 | A * | 7/1999 | Mizuno | 24/421 |
| 6,332,249 | B1 * | 12/2001 | Oda et al. | 24/421 |
| 6,647,598 | B2 * | 11/2003 | Lin | 24/420 |
| 6,654,988 | B1 * | 12/2003 | Chung | 24/421 |
| 6,769,156 | B1 * | 8/2004 | Chen | 24/421 |
| 7,356,887 | B2 * | 4/2008 | Iwase et al. | 24/421 |
| 7,650,674 | B2 * | 1/2010 | Miyazaki et al. | 24/424 |
| 7,870,650 | B2 * | 1/2011 | Keyaki et al. | 24/424 |
| 2002/0000025 | A1 * | 1/2002 | Yamagishi | 24/421 |
| 2002/0152591 | A1 * | 10/2002 | Nagata et al. | 24/421 |
| 2003/0079318 | A1 * | 5/2003 | Oda et al. | 24/429 |
| 2003/0182775 | A1 * | 10/2003 | Lin | 24/436 |
| 2004/0231114 | A1 | 11/2004 | Iwase et al. | |
| 2008/0148534 | A1 | 6/2008 | Iwase et al. | |
| 2011/0197403 | A1 * | 8/2011 | Keyaki et al. | 24/418 |
| 2012/0204384 | A1 | 8/2012 | Miyazaki et al. | |
| 2013/0160248 | A1 * | 6/2013 | Keyaki et al. | 24/388 |
| 2013/0174387 | A1 * | 7/2013 | Hamada | 24/418 |

FOREIGN PATENT DOCUMENTS

| | | | |
|---|---|---|---|
| CN | 102665474 | A | 9/2012 |
| JP | 137311/1982 | | 8/1982 |
| JP | 3-295502 | A | 12/1991 |
| JP | 09-168412 | A | 6/1997 |
| JP | 2002-10808 | A | 1/2002 |
| JP | 2003-235615 | A | 8/2003 |
| JP | 2004-344313 | A | 12/2004 |
| JP | 1382218 | | 3/2010 |
| WO | 2010/070744 | A1 | 6/2010 |
| WO | WO 2012042620 | A1 * | 4/2012 |
| WO | WO 2014064753 | A1 * | 5/2014 |

OTHER PUBLICATIONS

Written Opinion, PCT Application No. PCT/JP2011/063979, mailed Aug. 16, 2011.

Office Action, Japanese Patent Application No. 2013-520396, mailed Jul. 15, 2014.

Office Action, Japanese Patent Application No. 2013-520396, mailed Mar. 17, 2015.

Office Action, Chinese Patent Application No. 201180071716.5, mailed May 25, 2015.

* cited by examiner

SLIDER FOR SLIDER FASTENERS

This application is a national stage application of PCT/JP2011/063979, which is incorporated herein by reference.

TECHNICAL FIELD

The present invention relates to a slider for slide fastener, and more particularly, to a slider for slide fastener in which a pull-tab is maintained in a laid-down state with respect to a slider main body at normal times, i.e. while the slider is not being slid.

BACKGROUND ART

A slider for slide fastener of the related art includes a slider main body, a pull-tab attached to a pair of right and left pull-tab attachment posts which are erected on the upper surface of an upper blade of the slider main body, and a spring part disposed between the pair of right and left pull-tab attachment posts and having a locking claw at one end thereof (e.g. see Patent Document 1).

In addition, in the related art, there is a slider for slide fastener that is configured such that the pull-tab is maintained in the laid-down state with respect to the slider main body (e.g. see Patent Document 2). In the slider for slide fastener disclosed in Patent Document 2, a pin is fitted into bearings which protrude from an upper blade of the slider main body through the pull-tab, and a hinge spring is provided on this pin such that the pull-tab is always maintained in the laid-down state by the elastic force of the hinge spring. In addition, the slider is provided with the slider main body, a locking claw with a spring, the pull-tab provided with a cam surface, a leaf spring which applies an elastic force to the cam surface, and a cover body engaged with the slider main body to accommodate the leaf spring. The pull-tab is always maintained in the laid-down state by the elastic force of the leaf spring acting on the cam surface.

PRIOR ART DOCUMENT

Patent Document

Patent Document 1: International Publication No. WO 2010/070744 Al

Patent Document 2: Japanese Patent Application Publication No. H03-295502 A

SUMMARY OF INVENTION

Problems to Be Solved by Invention

However, in the slider for slide fastener disclosed in Patent Document 1, since the pull-tab attachment post or the spring part is exposed to the outside, there is a problem in that the external appearance and the hand feeling of the slider are deteriorated. In addition, when the spring part is exposed to the outside, the spring part is likely to be subject to an external impact or the like, and thus the spring part may be damaged.

Meanwhile, the slider for slide fastener disclosed in Patent Document 2 has the problem of the complicated structure. Since it is necessary to increase the size of the slider so that the hinge spring can be installed, the slider becomes heavy and it is difficult to reduce the slider in size. In addition, since automatic assembly is not considered in the shape of the slider, the slider is made by the manual mounting operation. Therefore, it was difficult to mass-produce the sliders. Furthermore, since the locking claw is configured such that it is accommodated in the upper blade of the slider main body, the weight is relatively increased. In addition, a detailed attachment structure of the cover body is not sufficiently described and the cover body may be detached when a strong force is applied to the pull-tab.

Accordingly, the present invention has been made keeping in mind the above problems occurring in the related art, and an object of the present invention is to provide a slider for slide fastener, in which the external appearance and the hand feeling of the slider can be improved, a spring part can be prevented from being deformed, the structure of the slider can be simplified, and the slider can be reduced in size and weight.

Means for Solving Problems

The object of the present invention is achieved by the following configurations.

(1) A slider for slide fastener including: a slider main body having an upper blade, a lower blade, a guide post which connects the upper blade to the lower blade, and first and second pull-tab attachment posts which are erected on an upper surface of the upper blade, the slider main body configured to engage and disengage a pair of fastener elements; a pull-tab attached to the first and second pull-tab attachment posts; a spring part disposed between the first and second pull-tab attachment posts, the spring part having a locking claw at one end thereof; and a cover body attached to the slider main body, the cover body covering the first and second pull-tab attachment posts and the spring part, wherein the pull-tab has a cam portion, and when the pull-tab is rotated from a laid-down state where the pull-tab is laid down toward one side of the slider main body to an erected state, the pull-tab is urged with using the cam portion in a direction in which the pull-tab reruns to the laid-down state by an elastic force of the spring part, and wherein the slider further comprising a restraining part configured to prevent the pull-tab from rotating further from the erected state and prevent the pull-tab from being laid down toward the other side of the slider main body.

(2) The slider for slide fastener according to (1), wherein the restraining part includes: a pull-tab-side restraining portion formed in the pull-tab; and a cover body-side restraining portion formed in the cover body, and wherein the pull-tab-side restraining portion is configured to abut to the cover body-side restraining portion so as to prevent the pull-tab from rotating further from the erected state.

(3) The slider for slide fastener according to (2), wherein the pull-tab has a shaft portion, a pair of connecting rods which are connected to the shaft portion, and an operating portion which is connected to the pair of connecting rod, and wherein the pull-tab-side restraining portion is formed in the connecting rods of the pull-tab.

(4) The slider for slide fastener according to any one of (1) to (3), wherein a contour forming a front end portion of the cover body at least at a side of the guide post has a same shape as a contour forming a front end portion of the upper blade.

(5) The slider for slide fastener according to (2), wherein the cover body has a wide-width portion which is disposed at a front end portion thereof and a narrow-width portion which extends rearward from the wide-width portion, and wherein the cover body-side restraining portion is formed in a shoulder portion of the wide-width portion, which extend outward beyond the narrow-width portion in a width direction.

(6) The slider for slide fastener according to (5), wherein the wide-width portion has a front top plate which extends beyond the narrow-width portion in a right and left direction, a front plate which extends downward from a front edge of the front top plate, a pair of right and left front side plates which extend downward from both side edges of the front top plate, and side rear plates which extend outward beyond the narrow-width portion in the width direction and respectively extend from rear edges of the front top plate, and wherein the shoulder portion is formed on the side rear plates.

(7) The slider for slide fastener according to (5) or (6), wherein side surfaces of the narrow-width portion are formed with a penetration hole through which the shaft portion of the pull-tab is penetratable, and wherein when the pull-tab is in the laid-down state, positions of at least upper surfaces of the connecting rods of the pull-tab are at an equal height to or higher than an upper end of the shaft portion of the pull-tab and are at an equal height to or lower than an upper surface of the cover body.

(8) The slider for slide fastener according to any one of (2) to (7), wherein the pull-tab-side restraining portion is a protrusion provided on the upper surfaces of the connecting rods, and wherein the cover body-side restraining portion is an inclined surface provided on the shoulder portion of the cover body and extending from a front end portion to a rear end portion of the slider main body.

(9) The slider for slide fastener according to any one of (1) to (8), wherein the restraining part prevents the pull-tab from rotating when a contact position between the spring part and the cam portion is within a range from a start point to an end point of the cam surface of the cam portion.

(10) The slider for slide fastener according to any one of (1) to (9), wherein the cam portion has a protrusion which protrudes toward the operating portion beyond the shaft portion which has a central axis, wherein the protrusion has an inclined surface which is inclined downward from an upper surface side to a lower surface side of the pull-tab, and wherein the cam surface is within a range of the inclined surface.

(11) The slider for slide fastener according to any one of (1) to (10), wherein the cam portion has a flat surface formed at an upper surface side of the pull-tab and an inclined surface formed on a surface which faces the operating portion, and wherein only a portion of the flat surface at a side of the cam surface is elastically urged by the spring part.

Advantageous Effects of Invention

In the slider for slide fastener according to the present invention, since the slider is provided with the slider main body, the spring part disposed between the first and second pull-tab attachment posts of the slider main body and having the locking claw at one end thereof, and the cover body covering the first and second pull-tab attachment posts and the spring part, the first and second pull-tab attachment posts and the spring part are not exposed to the outside. Consequently, it is possible to improve the external appearance and the hand feeling of the slider and to prevent the spring part from being deformed without intention.

In addition, in the slider for slide fastener according to the present invention, the pull-tab has the cam portion, when the pull-tab is rotated from the laid-down state where the pull-tab is laid down toward the one side of the slider main body to the erected state, the pull-tab is urged with using the cam portion in the direction in which the pull-tab returns to the laid-down state by the elastic force of the spring part, and the slider is further provided with the pull-tab-side restraining portion and the cover body-side restraining portion which prevent the pull-tab from rotating further from the erected state and prevent the pull-tab from being laid down toward the other side of the slider main body. Consequently, the pull-tab can be always maintained in a state where the pull-tab is laid down toward the one side, e.g., a side of the rear mouth, except when the pull-tab is being operated, thereby improving the operability of the slider. In addition, since the above-described functions are realized with the simple structure, the slider can be reduced in size and weight. In addition, it is possible to assemble the slider with using an automatic assembly apparatus.

EMBODIMENTS OF INVENTION

Hereinafter, embodiments of a slider for slide fastener according to the present invention will be described in detail with reference to the accompanying drawings. In the following description, a side of shoulder mouths refers to a wide-width side of the slider, through which disengaged fastener elements come out, and a side of a rear mouth refers to a narrow-width side of the slider, through which engaged fastener elements come out. In addition, the side of the shoulder mouths refers to a front side, the side of the rear mouth refers to a rear side, a direction in which the slider slides refers to a front and rear direction, a direction that is perpendicular the front and rear direction and parallel to a fastener tape (not shown) refers to a right and left direction (width direction), and a direction that is perpendicular to the front and rear direction and the right and left direction refers to an upward and downward direction.

[First Embodiment]

First, a first embodiment of a slider for slide fastener will be described with reference to FIG. 1 to FIG. 9.

Figure 1:
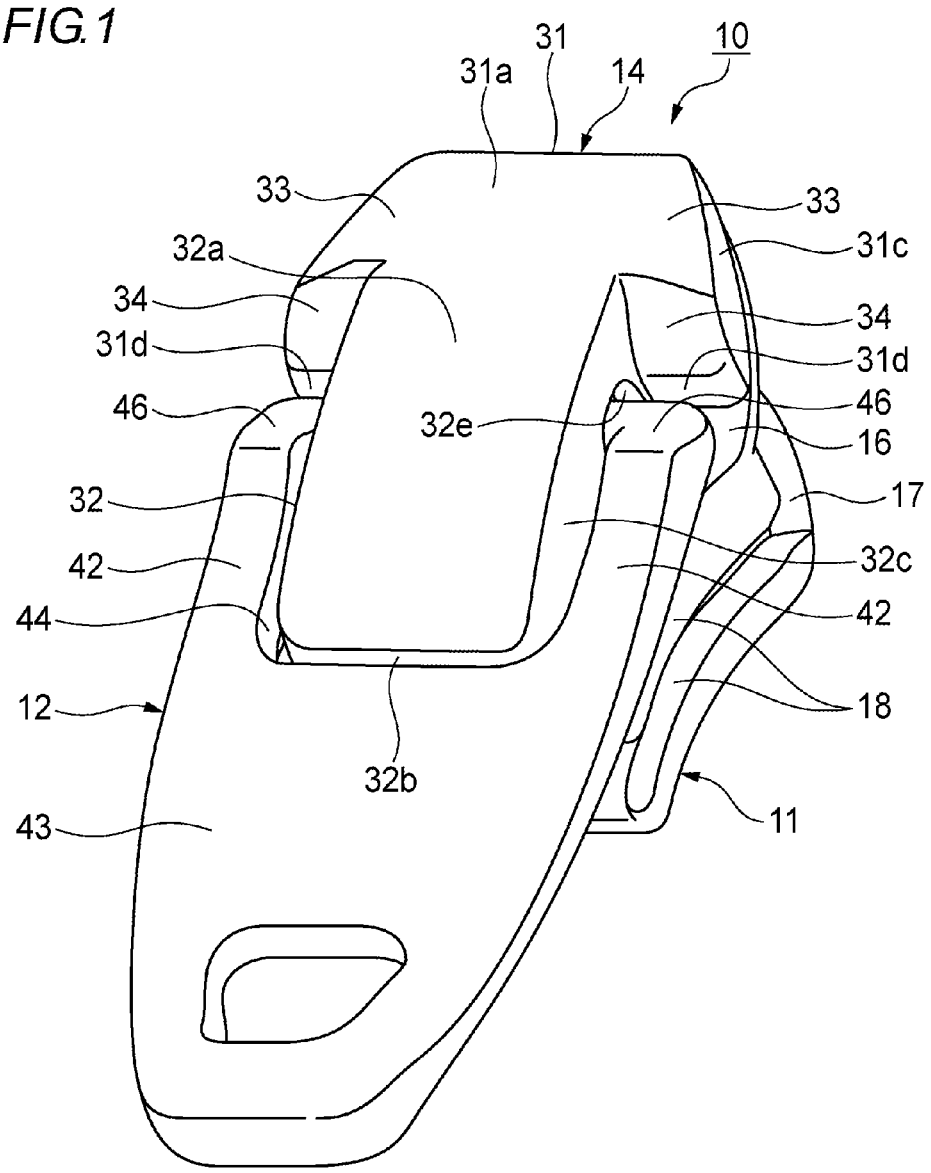
FIG. 1 is a perspective view illustrating a first embodiment of a slider for slide fastener according to the present invention.
Figure 2:
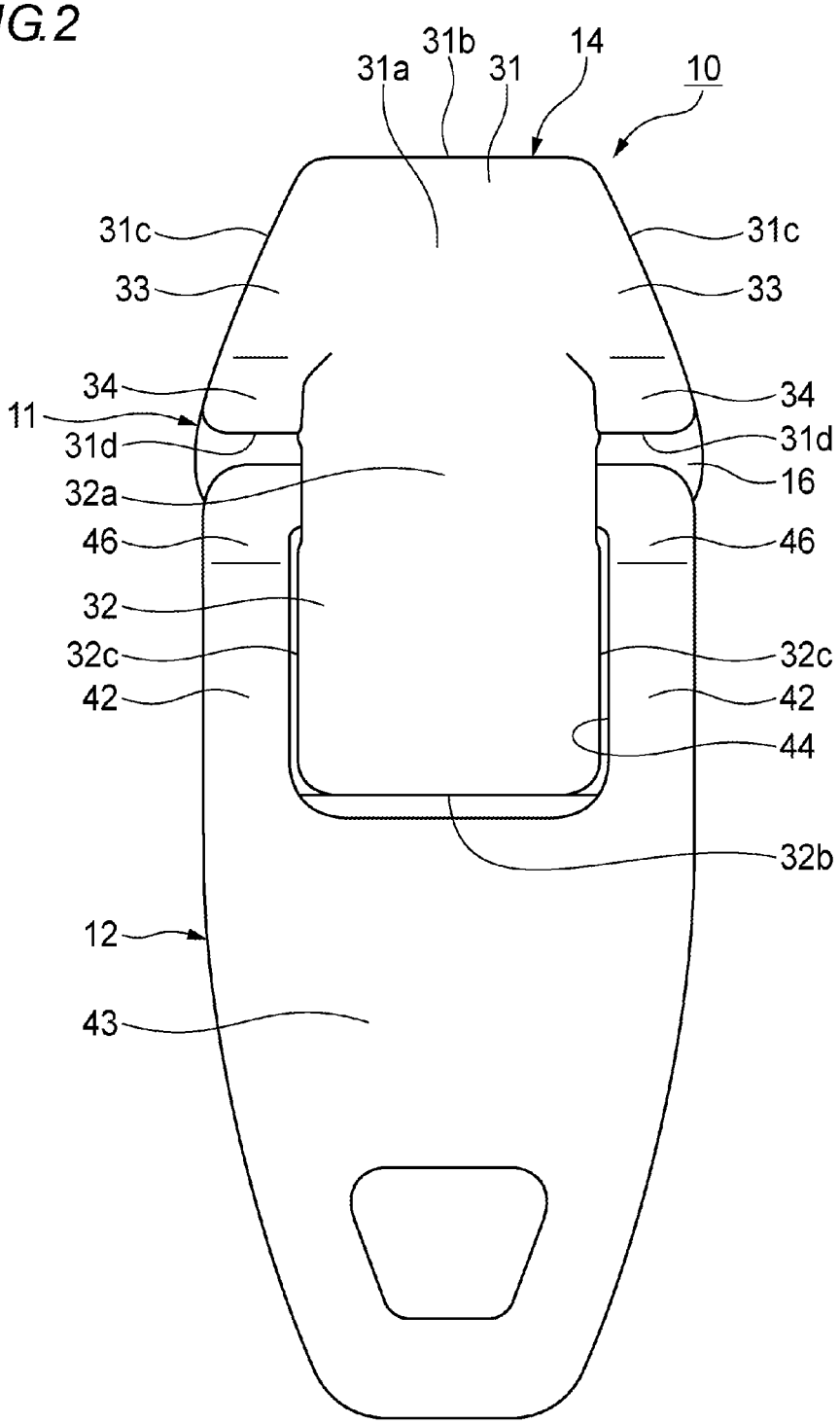
FIG. 2 is a top plan view of the slider for slide fastener shown in FIG. 1.
Figure 3:
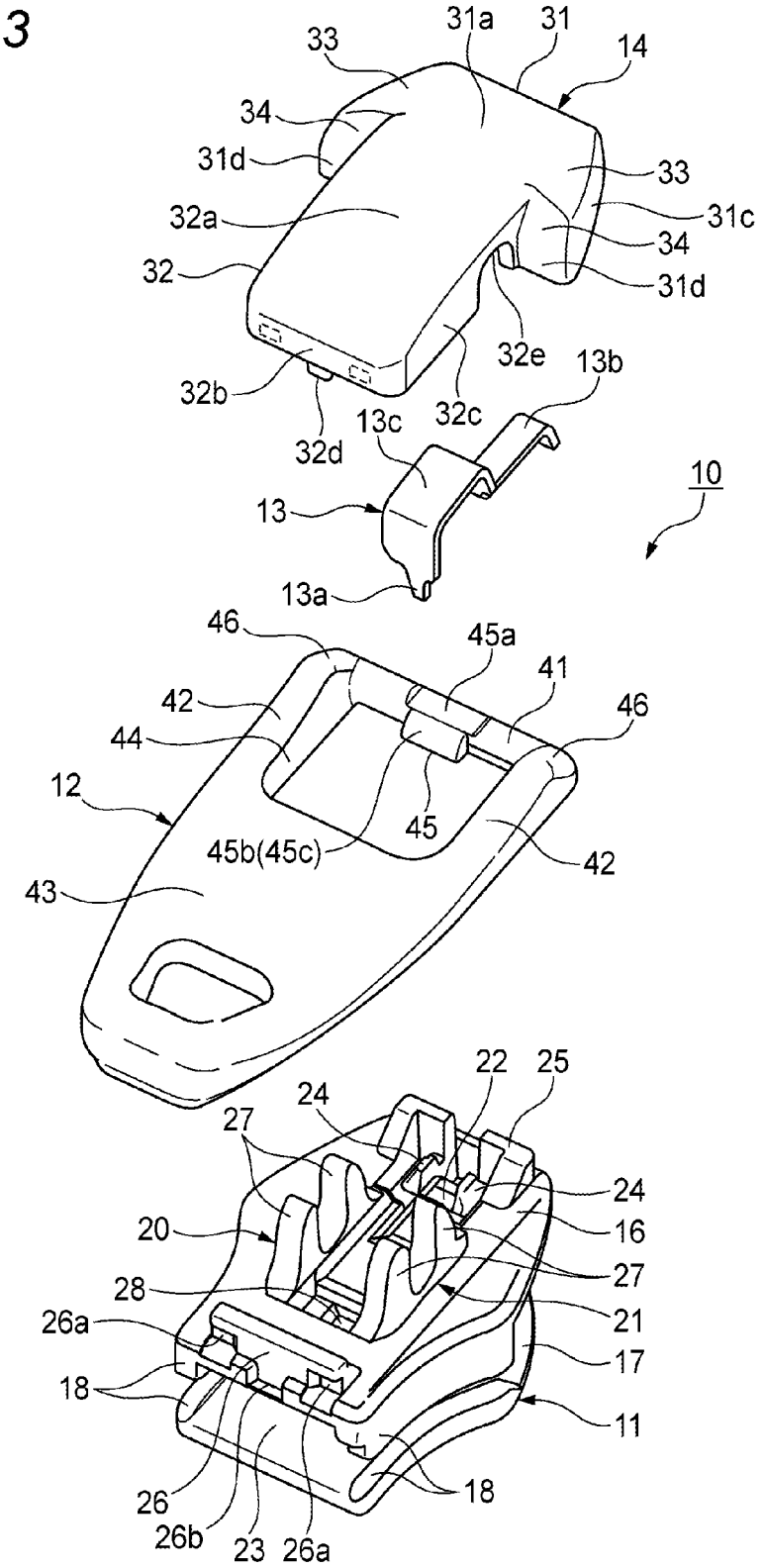
FIG. 3 is an exploded perspective view of the slider for slide fastener shown in FIG. 1.

As shown in FIG. 1 to FIG. 3, the slider 10 for slide fastener (hereinafter simply referred to as "slider") according to the present embodiment includes a slider main body 11, a pull-tab 12, spring part 13 and a cover body 14.

Figure 6:
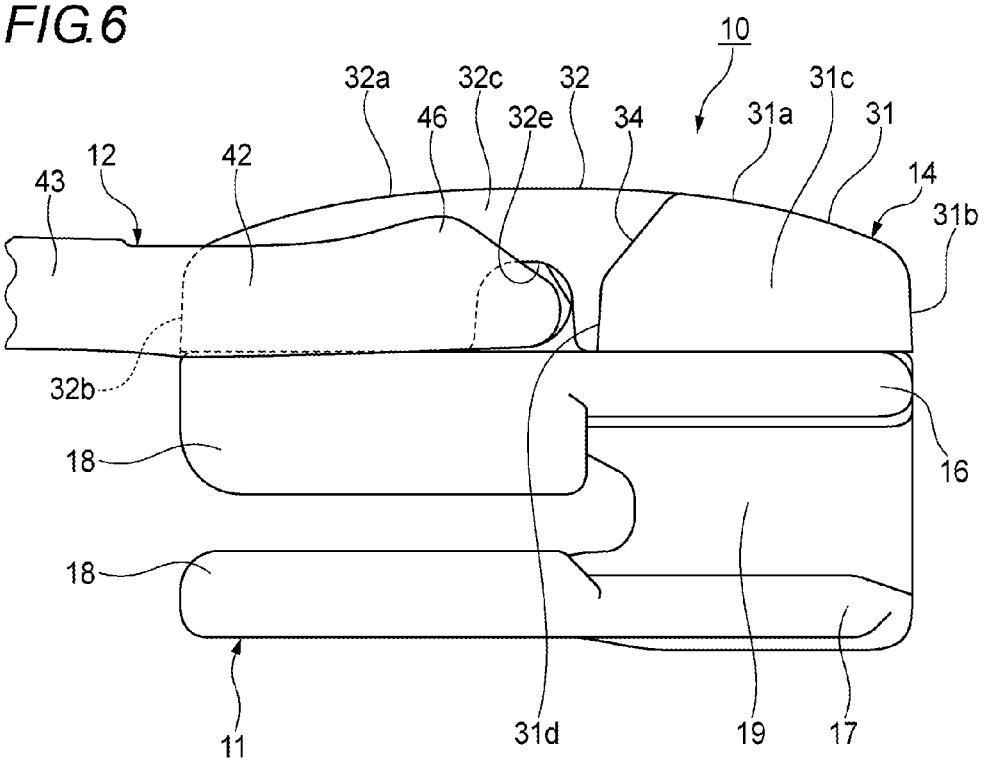
FIG. 6 is a side view of the slider for slide fastener shown in FIG. 1 when the pull-tab is in the laid-down state.
Figure 7:
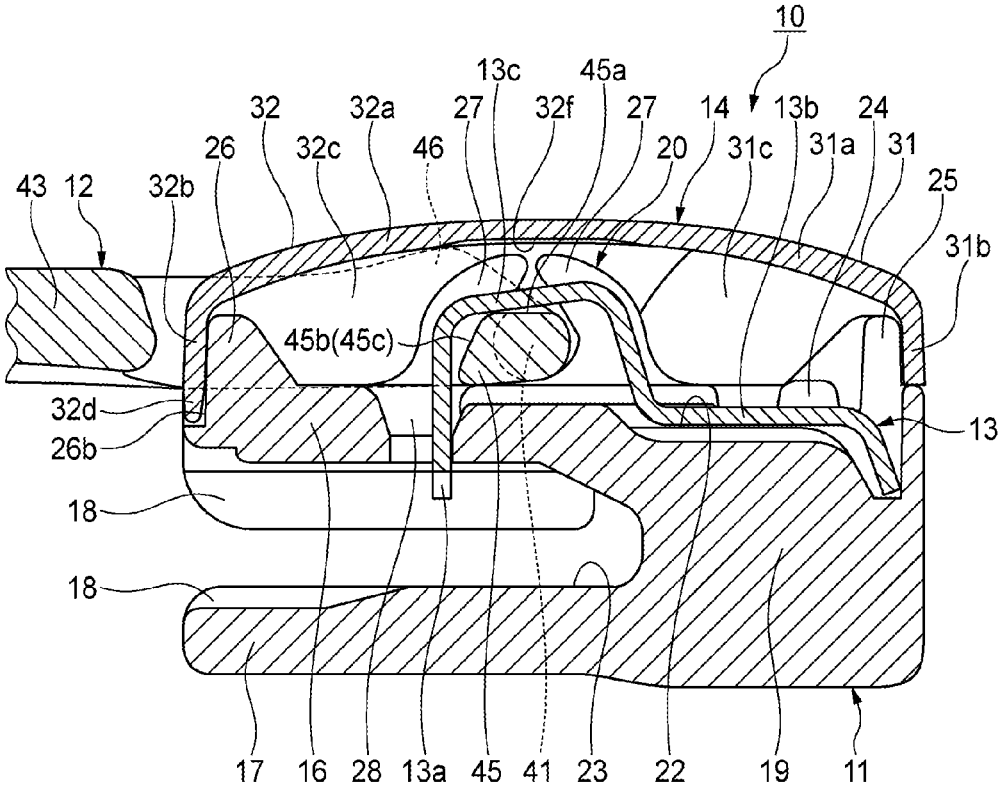
FIG. 7 is a longitudinal cross-sectional view of the slider for slide fastener shown in FIG. 6.

As shown in FIG. 3, FIG. 6 and FIG. 7, the slider main body 11 includes upper and lower blades 16 and 17 which are disposed in parallel so as to be spaced apart in the upward and downward direction and a guide post 19 which connect the upper and lower blades 16 and 17 to each other. A pair of right and left flanges 18 are provided along right and left edges of the upper and lower blades 16 and 17. The pair of right and left flanges 18 include upper flanges formed on the upper blade 16 and the lower flanges which are formed on the lower blade 17. The guide post 19 connects the upper and lower blades 16 and 17 to each other at central portions thereof at the side of the shoulder mouths in the width direction, and a Y-shaped element guide path 23 is formed between the upper and lower blades 16 and 17 such that the guide post 19 forms a diverging point of the Y-shaped element guide path 23.

Figure 5:
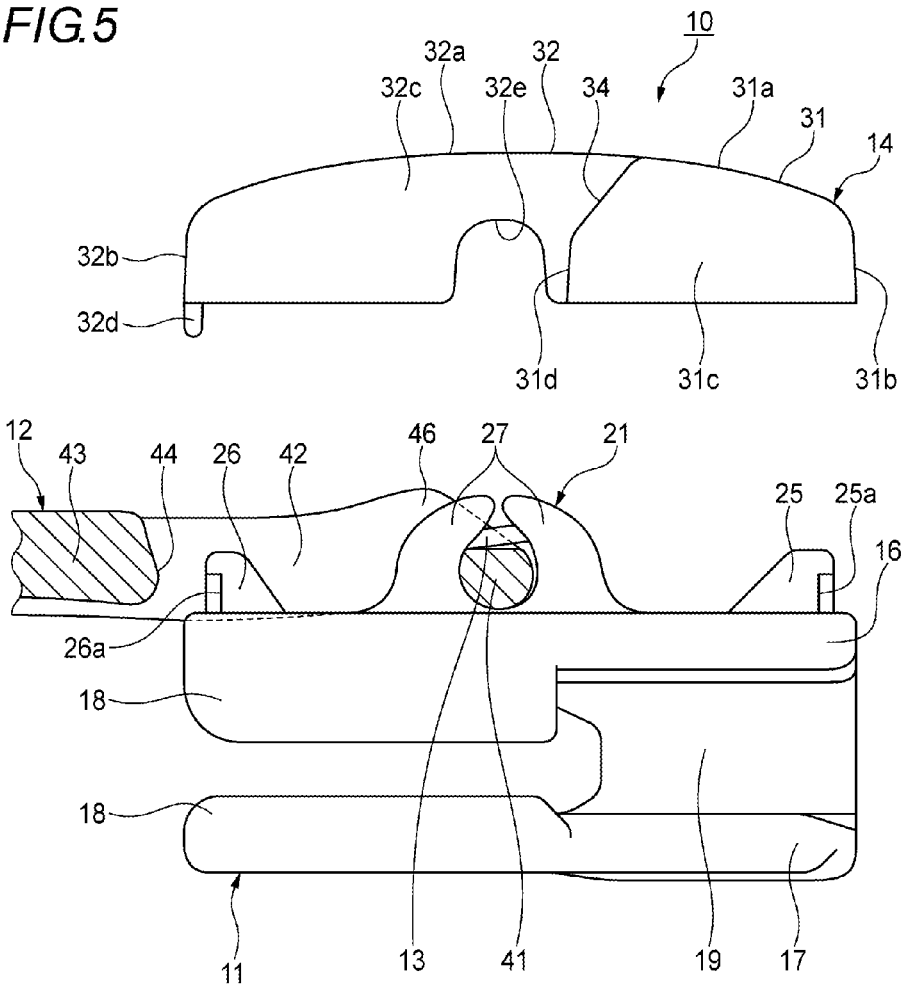
FIG. 5 is a side view of the slider for slide fastener shown in FIG. 1 before the cover body is attached.

As shown in FIG. 3 and FIG. 5, the upper blade 16 of the slider main body 11 includes first and second pull-tab attachment posts 20 and 21, an insert recess 22, a pair of right and left crimping portions 24, and front and rear fixing posts 25 and 26. The first and second pull-tab attachment posts 20 and 21 are erected on a substantially central portion of the upper surface of the upper blade 16 and rotatably hold a shaft portion 41 of the pull-tab 12 which will be described later. The insert recess 22 is formed in a central portion of the upper surface of the upper blade 16 in the right and left direction and the spring part 13 is inserted into the insert recess 22. The pair of right and left crimping portions 24 are erected on the front end portion of the upper surface of the upper blade 16 so as to sandwich the insert recess 22. The front and rear fixing posts 25 and 26 are respectively erected on the front and rear end portions of the upper surface of the upper blade 16 and fixedly crimp the cover body 14.

Crimping recesses 25*a* and 26*a* for fixedly crimping the cover body 14 are respectively formed on right and left end portions of the front surface of the front fixing post 25 and right and left end portions of the rear surface of the rear fixing post 26.

The first pull-tab attachment post 20 has a pair of crimping protrusions 27 formed along the front and rear direction and the second pull-tab attachment post 21 has a pair of crimping protrusions 27 formed along the front and rear direction, the pairs of crimping protrusions 27 are provided so as to protrude on both sides of the insert recess 22. After the shaft portion 41 of the pull-tab 12 is inserted between the front and rear crimping protrusions 27, the front and rear crimping protrusions 27 are crimped by being bent in approaching direction to each other, such that the shaft portion 41 of the pull-tab 12 is rotatably attached to the first and second pull-tab attachment posts 20 and 21.

The insert recess 22 has a recess width that is equal to or slightly greater than the width dimension (a dimension in the right and left direction) of the spring part 13 such that the spring part 13 can be stably inserted into the insert recess 22. In addition, as shown in FIG. 7, a stepped portion corresponding to the shape of the spring part 13 is provided on the bottom of the insert recess 22. The stepped portion extends in a stepped manner in a longitudinal direction of the insert recess 22. In addition, a claw hole 28 is formed in the rear end portion of the insert recess 22 so as to penetrate through the upper blade 16 in the upward and downward direction, such that a locking claw 13*a* of the spring part 13 which will be described later can be inserted into the claw hole 28 when the spring part 13 is disposed inside the insert recess 22.

As shown in FIG. 1 to FIG. 3, the cover body 14 is substantially T-shaped when viewed from above. The cover body 14 has a wide-width portion 31 which is disposed at the front end portion thereof and a narrow-width portion 32 which extends rearward from the central portion of the wide-width portion 31 in the right and left direction. The cover body 14 covers the first and second pull-tab attachment posts 20 and 21 and the spring part 13.

The wide-width portion 31 has a front top plate 31*a* which extends beyond the narrow-width portion 32 in the right and left direction, a front plate 31*b* which extends downward from the front edge of the front top plate 31*a*, a pair of right and left front side plates 31*c* which extend downward from both side edges of the front top plate 31*a*, and side rear plates 31*d* which extend outward beyond the narrow-width portion in the width direction and respectively extend from rear edges of the front top plate 31*a* at right and left shoulder portions 33 of the wide-width portion 31. In addition, the contour forming the wide-width portion 31 has the same shape as the contour forming the front end portion of the upper blade 16 when viewed from above. Here, the front end portion of the upper blade 16 refers to a portion between the front end portions of the upper and lower flanges 18 which are formed at the right and left.

The narrow-width portion 32 has a rear top plate 32*a* which extends in the front and rear direction, a rear plate 32*b* which extends downward from the rear edge of the rear top plate 32*a* and a pair of right and left side plates 32*c* which extend downward from both side edges of the rear top plate 32*a*.

In addition, as shown in FIG. 3 and FIG. 5, a protrusion 32*d* which extends downward is formed at the center portion of the lower edge of the rear plate 32*b* in the right and left direction. The protrusion 32*d* is engaged with a recess 26*b* which is formed at the central portion of the rear fixing post 26 in the right and left direction. In addition, front end portions of the right and left rear side plates 32*c* are respectively formed with penetration holes 32*e* through which the shaft portion 41 of the pull-tab 12 is penetratable. An inner surface of the rear top plate 32*a* is formed with a recess 32*f* into which the spring part 13 which is moved up by a cam portion 45 of the pull-tab 12 is retracted. With this configuration, the cover body 14 can be made as thin as possible.

As shown in FIG. 5, the right and left side rear plates 32*d* of the sholder portions 33 are respectively formed with cover body-side restraining portions 34 which prevent the pull-tab 12 from excessively rotating. The cover body-side restraining portions 34 are formed into inclined surfaces that extend from the front end portion to the rear end portion of the slider main body 11 and are downwardly inclined in the rearward direction.

The cover body 14 is fixed to the upper blade 16 by putting the cover body 14 over the front fixing post 25 and the rear fixing post 26 of the upper blade 16, crimping the front plate 31*b* to the right and left crimping recesses 25*a* of the front fixing post 25, and crimping the rear plate 32*b* to the right and left crimping recesses 26*a* of the rear fixing post 26.

Figure 4:
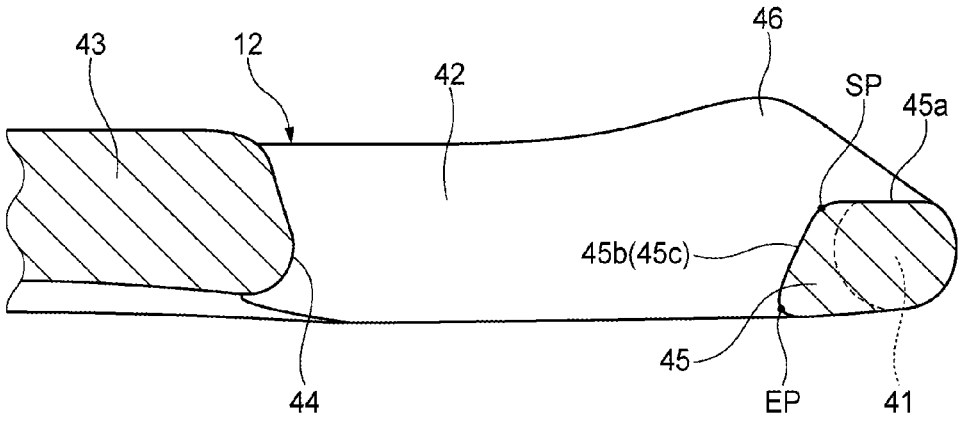
FIG. 4 is a longitudinal cross-sectional view of a cam portion of a pull-tab shown in FIG. 3.

As shown in FIG. 3 and FIG. 4, the pull-tab 12 has the cylindrical shaft portion 41 which has a central axis, a pair of right and left connecting rods 42 connected to the shaft portion 41 at one ends thereof, a operating portion 43 connected to the other ends of the pair of right and left connecting rods 42. A substantially rectangular pull-tab opening 44 is defined by the shaft portion 41, the pair of right and left connecting rods 42 and the operating portion 43.

In the state where an external force is not applied to the pull-tab 12, the pull-tab 12 is maintained at a position where the pull-tab 12 is parallel to the upper surface of the upper blade 16, i.e. in the laid-down state by the spring force of the spring part 13. Although the state where the pull-tab 12 is laid down in the direction toward the rear mouth is explained as the laid-down state in this embodiment, the direction is not necessarily toward the rear mouth. For instance, the pull-tab 12 can be configured so as to be laid down in the direction toward the shoulder mouths, and such a state can be referred to as the laid-down state.

The cam portion 45 extends from the central portion of the shaft portion 41 in an axial direction thereof so as to protrude toward the operating portion 43 beyond the shaft portion 41 which has the central axis. The cam portion 45 has a flat surface 54*a* which is formed on a side of the upper surface of the pull-tab 12 and an inclined surface 45*b* which is formed on a surface that faces the operating portion 43. In other words, the inclined surface 45*b* is provided on the surface that constitutes the inner wall of the opening 44 of the pull-tab 12. The inclined surface 45*b* is configured so as to be inclined downward from a side of the upper surface of the pull-tab 12 toward a side of the lower surface of the pull-tab 12 when the pull-tab 12 is in the laid-down state. Here, a portion or the whole of the inclined surface 45*b* acts as a cam surface 45*c* that can contact the spring part 13. The cam surface 45*c* urges the pull-tab 12 in the direction of returning the pull-tab 12 to the laid-down state in cooperation with the spring part 13 which will be described later. In addition, the cam surface 45*c* is within the range of a start point SP and an end point EP of the inclined surface 45*b*. The start point SP refers to the point where the locking claw 13*a* starts moving up when the pull-tab 12 is rotated. The end point EP refers to the point where the pull-tab 12 no longer rotates as the restraining portions 34 and 46 contact each other after the pull-tab 12 is rotated. In addition, the inclined surface 45*b* may be a curved surface or a linear surface.

In addition, the pull-tab-side restraining portions 46 are respectively formed on the upper surfaces of the front end portions of the right and left connecting rods 42. Each of the pull-tab-side restraining portions 46 is a protruding portion that has a substantially triangular shape when viewed from the side. In addition, the front surfaces of the pull-tab-side restraining portions 46 which are inclined downward in the forward direction are formed so as to respectively continue to the front end portions of the connecting rods 42. In addition, the pull-tab-side restraining portions 46 constitute a restraining part together with the cover body-side restraining portions 34 to prevent the pull-tab 12 from excessively rotating as the pull-tab-side restraining portions 46 abut on the cover body-side restraining portions 34.

The spring part 13 is manufactured by press-molding a spring plate of, for example, stainless steel. As shown in FIG. 3 and FIG. 7, the spring part 13 has the locking claw 13*a* formed in the rear end portion of the spring part 13 and configured to protrude into and retracted from the element guide path 23 through the claw hole 28 of the slider main body 11, a hook portion 13*b* formed in the front end portion of the spring part 13 and configured to be fitted to the insert recess 22 of the slider main body 11, and a cover portion 13*c* formed between the locking claw 13*a* and the hook portion 13*b* and configured to cover the shaft portion 41 and the cam portion 45 of the pull-tab 12 from above.

After the spring part 13 is inserted between the first and second pull-tab attachment posts 20 and 21 and into the insert recess 22, the spring part 13 is fixed to the upper blade 16 by crimping the right and left crimping portions 24 of the upper blade 16 to be bent inward. When the pull-tab 12 is operated so as to be moved up (to the erected state) through the operating portion 43 by external force, e.g. by a human hand, the spring part 13 is pushed upward by the cam surface 45*c* to escape from the element guide path 23, thereby allowing the slider 10 to move. When the pull-tab 12 is laid down (to the laid-down state), the spring part 13 enters into the element guide path 23 and then enters between faster elements (now shown) which exist within the element guide path 23, thereby restraining the movement of the slider 10. As shown in FIG. 7, the spring part 13 elastically urges a portion of the flat surface 45*a* of the cam portion 45 at the side of the cam surface 45*c* toward a side of the upper blade 16 with using the cover portion 13*c* by the elastic force of the hook portion 13*b*, thereby maintaining the pull-tab 12 in the laid-down state.

In the slider 10 for slide fastener configured as above, as shown in FIG. 6 and FIG. 7, in the laid-down state where the pull-tab 12 is laid down toward the rear mouth, since the portion of the flat surface 45*a* of the cam portion 45 at the side of the cam surface 45*c* is pressed toward the side of the upper blade 16 by the cover portion 13*c* of the spring part 13, the laid-down state where the pull-tab 12 is laid down toward the side of the rear mouth is maintained. In particular, it is preferred that only the rear side of the flat surface 45*a* of the cam portion 45 relative to the middle position in the front and rear direction is brought into contact with the cover portion 13*c* of the spring part 13. Due to this configuration, the elastic force of the spring part 13 can be reliably applied to the pull-tab 12, thereby preventing the pull-tab 12 from shaking. It is set such that, when the pull-tab 12 is in the laid-down state, the connecting rods 42 of the pull-tab 12 overlap with the upper surface of the upper blade 16, the positions of at least the upper surfaces of the connecting rods 42 of the pull-tab 12 are at the equal height to or higher than the upper end of the shaft portion 41 of the pull-tab 12 and are at the equal height to or lower than the upper surface of the upper blade 16. At this time, the locking claw 13*a* of the spring part 13 enters into the element guide path 23 through the claw hole 28 of the upper blade 16, thereby preventing the slider 10 from moving.

Figure 8:
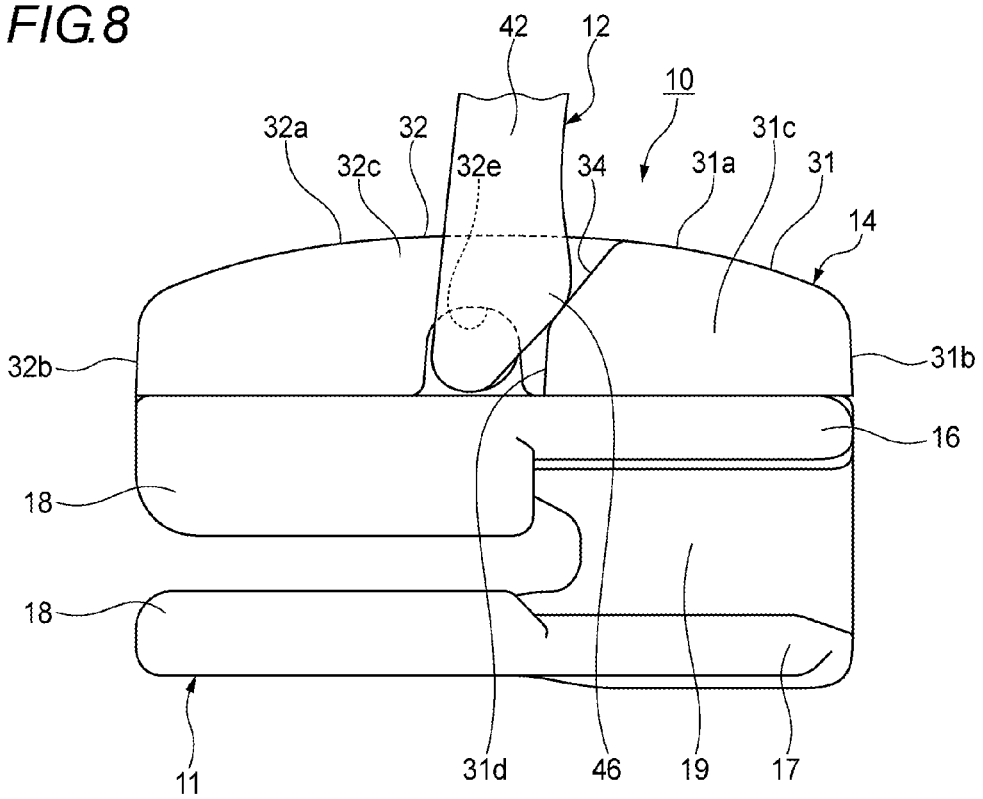
FIG. 8 is a side view of the slider for slide fastener shown in FIG. 1 when the pull-tab is in the erected state.
Figure 9:
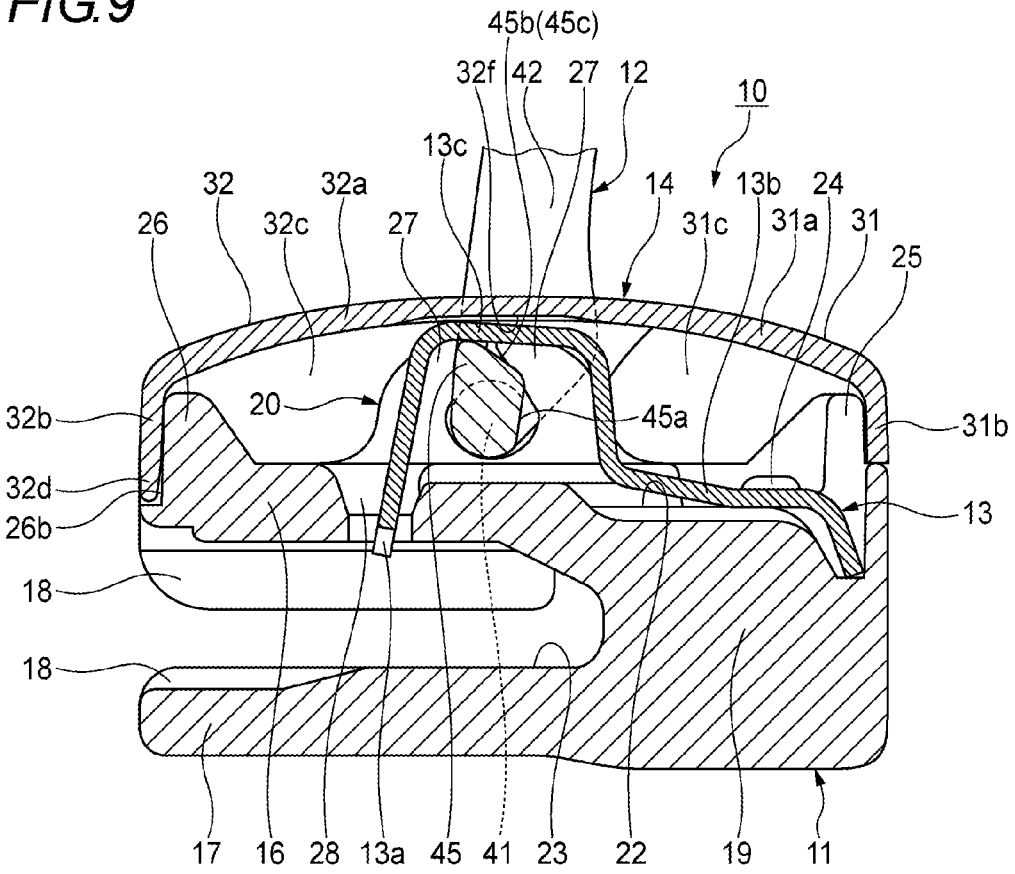
FIG. 9 is a longitudinal cross-sectional view of the slider for slide fastener shown in FIG. 8.

As shown in FIG. 8 and FIG. 9, when the pull-tab 12 is operated so as to rotate about the shaft portion 41 from the laid-down state into the erected state (in a clockwise direction in FIG. 8), the spring part 13 is pushed upward by the cam surface 45*c* of the cam portion 45 against the elastic force of the spring part 13. Then, the locking claw 13*a* of the spring part 13 escapes from the element guide path 23, thereby allowing the slider 10 to move. The rotatable range of the pull-tab 12 is until the pull-tab-side restraining portions 46 abut to the cover body-side restraining portions 34.

Here, since the elastic force of the spring part 13 is acting on the cam surface 45*c* of the pull-tab 12, the pull-tab 12 is always urged to the position where the pull-tab 12 was in the laid-down state at first (in the rearward direction in this embodiment). Therefore, when the pull-tab 12 is released, the pull-tab 12 rotates in the counterclockwise direction from the erected state and returns to the laid-down state where the pull-tab 12 is laid down toward the rear mouth.

Here, assuming that the pull-tab 12 is designed such that it can rotate to the position where the contact position between the spring part 13 and the cam surface 45*c* is beyond the end point EP of the cam surface 45*c* and beyond the inclined surface 45*b*, the pull-tab 12 comes into the laid-down state in the opposite direction from the initial laid-down state, i.e. is laid down toward the shoulder mouths, or the pull-tab 12 stays at the erected state without being laid down in any direction. However, in this embodiment, the restraining parts which restrain the rotation of the pull-tab 12 is designed such that the contact position between the spring part 13 and the cam surface 45*c* is within the range from the start point SP to the end point EP of the cam surface 45*c* that is a part of the inclined surface 45*b*. Therefore, when it is attempted to rotate pull-tab 12 further in the clockwise direction from the erected state shown in FIG. 8, the pull-tab-side restraining portions 46 of the pull-tab 12 abut to the cover body-side restraining portions 34 to restrain further rotation of the pull-tab 12 from the erected state, thereby preventing the pull-tab 12 from being laid down toward the shoulder mouths.

As described above, according to the slider 10 for slide fastener of this embodiment, since the slider 10 is provided with the slider main body 11, the spring part 13 disposed between the first and second pull-tab attachment posts 20 and 21 of the slider main body 11 and having the locking claw 13*a* at one end thereof, and the cover body 14 attached to the slider main body 11 and covering the first and second pull-tab attachment posts 20 and 21 and the spring part 13, the first and second pull-tab attachment posts 20 and 21 and the spring part 13 are not exposed to the outside. Consequently, it is possible to improve the external appearance and the hand feeling of the slider 10 and to prevent the spring part 13 from being deformed without intention.

In addition, in the slider 10 for slide fastener according to this embodiment, the pull-tab 12 has the cam portion 45, when the pull-tab 12 is rotated to the erected state from the laid-down state where the pull-tab 12 is laid down toward the rear mouth of the slider main body 11, the pull-tab 12 is urged with using the cam portion 45 in the direction in which the pull-tab 12 returns to the laid-down state by the elastic force of the spring part 13, and the slider 10 is further provided with the pull-tab-side restraining portions 46 and the cover body-side restraining portions 34 which prevent the pull-tab 12 from rotating further from the erected state and prevent the pull-tab 12 from being laid down toward the shoulder mouth of the slider main body 11. Consequently, the pull-tab 12 can be always maintained in the laid-down state where the pull-tab 12 is laid down toward the rear mouth except when the pull-tab 12 is being operated. Since it is possible to prevent the pull-tab 12 from being laid down toward the shoulder mouths, the operability can be improved. In addition, since the above-described functions are realized with the simple structure, the slider can be reduced in size and weight. Further, it is possible to assemble the slider 10 with using an automatic assembly apparatus.

Furthermore, in the slider 10 for slide fastener according to this embodiment, the restraining part includes the pull-tab-side restraining portions 46 formed in the pull-tab 12 and the cover body-side restraining portions 34 formed in the cover body 14. The pull-tab-side restraining portions 46 abut to the cover body-side restraining portions 34 so as to prevent the pull-tab 12 from rotating further from the erected state. It is therefore possible to reliably prevent the pull-tab 12 from rotating excessively, thereby improving the operability of the slider 10.

In the slider 10 for slide fastener according to this embodiment, the pull-tab-side restraining portions 46 are formed in the connecting rods 42 of the pull-tab 12 and the cover body-side restraining portions 34 are formed in the shoulder portions 33 of the wide-width portion 31 of the cover body 14. It is therefore possible to prevent the pull-tab 12 from rotating excessively without arranging a special restraining member.

Furthermore, in the slider 10 for slide fastener according to this embodiment, the contour forming the front end portion of the cover body 14 at least at the side of the guide post 19 has the same shape as the contour forming the front end portion of the upper blade 16. It is therefore possible to improve the external appearance of the cover body 14 and the slider 10.

In the slider 10 for slide fastener according to this embodiment, when the pull-tab 12 is in the laid-down state, positions of at least the upper surfaces of the connecting rods 42 of the pull-tab 12 are at the equal height to or higher than the upper end of the shaft portion 41 of the pull-tab 12 and are at the equal height to or lower than the upper surface of the cover body 14. Therefore, the slider 10 with the pull-tab 12 can have a flat configuration.

In the slider 10 for slide fastener according to this embodiment, the pull-tab-side restraining portions 46 and the cover body-side restraining portions 34 prevent the pull-tab 12 from rotating when the contact position between the spring part 13 and the cam portion 45 is within the range from the start point SP to the end point EP of the cam surface 45*c* of the cam portion 45. Consequently, the contact position between the spring part 13 and the cam portion 45 is not out of the cam surface 45*c*. Accordingly, the elastic force of the spring part 13 acting on the cam surface 45*c* can reliably return the pull-tab 12 to the laid-down state where the pull-tab 12 is laid down toward the rear mouth.

In the slider 10 for slide fastener according to this embodiment, since the portion of the flat surface 45*a* of the cam portion 45 at the side of the cam surface 45*c* is elastically urged by the spring part 13, the contact position between the spring part 13 and the flat surface 45*a* becomes farthest from the crimping portions 24 which fix the spring part 13. This causes the elastic force of the spring part 13 acting on the flat surface 45*a* to be strongest, whereby the pull- tab 12 can be maintained further in the laid-down state.

[Modified Embodiment]

Figure 10:
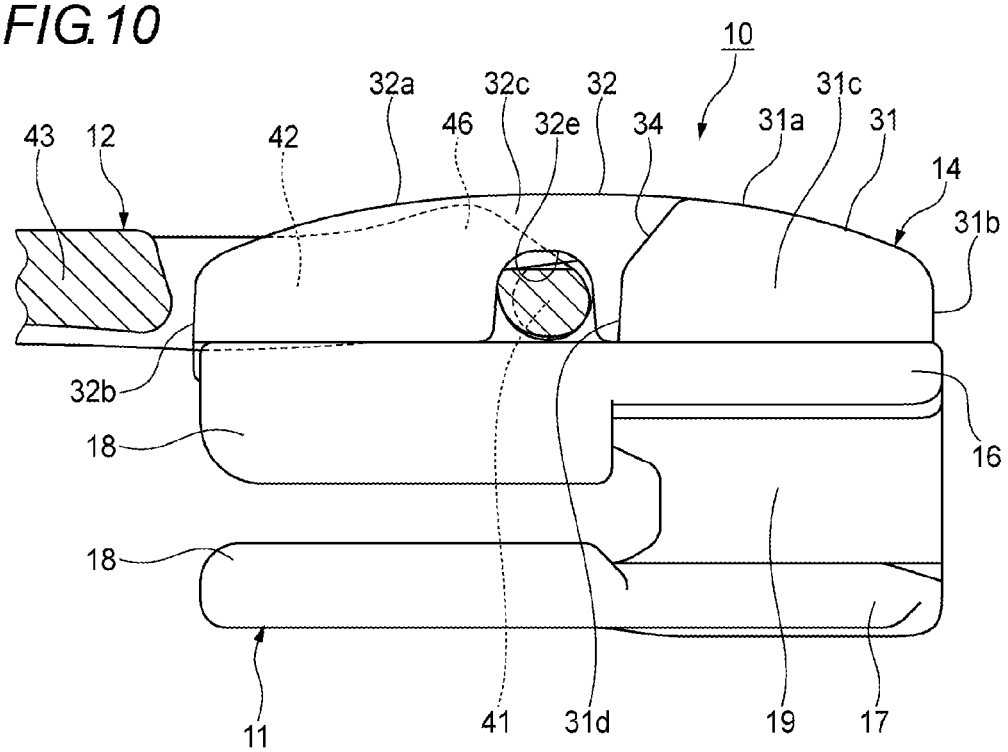
FIG. 10 is a side view illustrating a modified embodiment of the slider for slide fastener according to the first embodiment.
Figure 11:
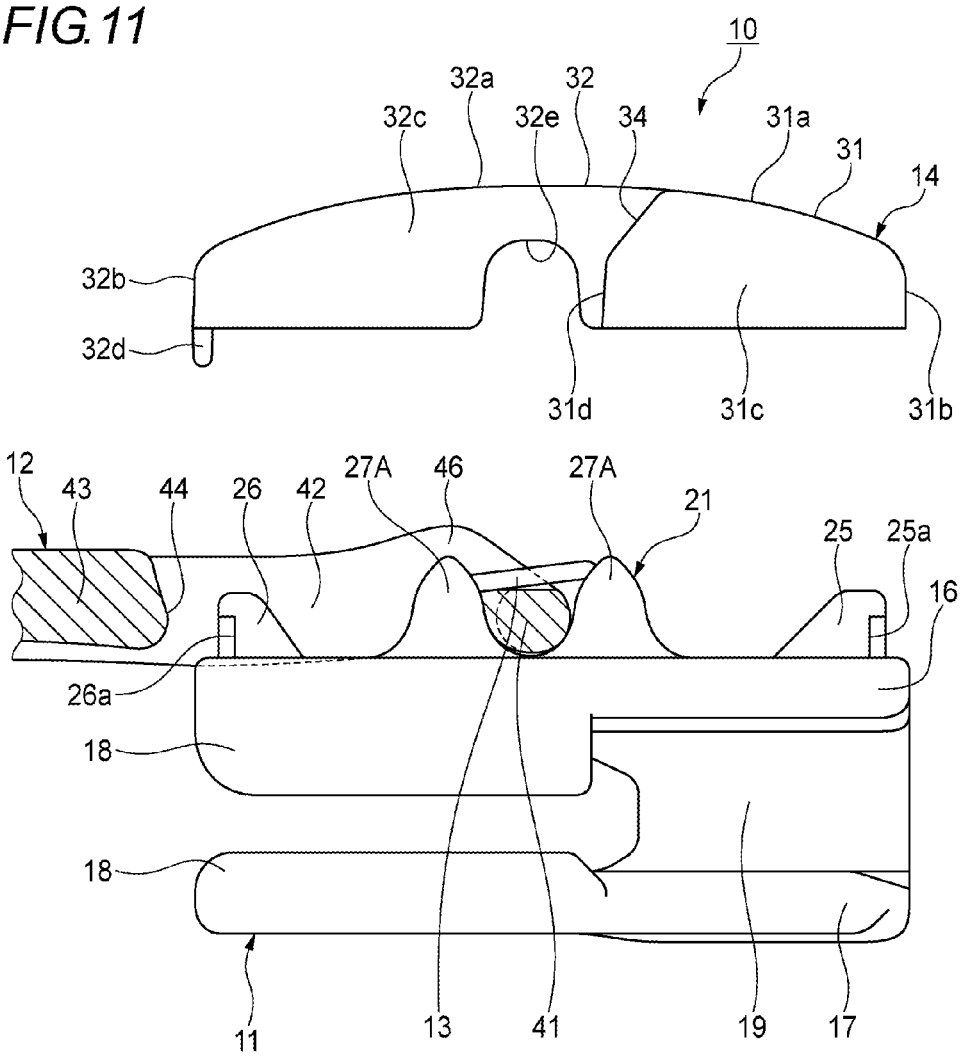
FIG. 11 is a side view of the slider for slide fastener shown in FIG. 10 before the cover body is attached.

According to a modified embodiment of this embodiment, as shown in FIG. 10 and FIG. 11, a pair of positioning protrusions 27A which protrudes in the front and rear direction may be formed in front and behind the first and second pull-tab attachment posts 20 and 21 instead of the crimping protrusions 27. The positioning protrusions 27A are used for positioning the pull-tab 12 in the front and rear direction. In this case, since crimping is not required, the length of the protrusions 27A can be reduced. In addition, in this case, the shaft portion 41 of the pull-tab 12 is rotatably supported by the penetration holes 32*e* at the right and left of the cover body 14.

According to this modified embodiment, it is possible to simplify the manufacturing process since it is not required to crimp the first and second pull-tab attachment posts 20 and 21. Furthermore, since the thickness of the cover body 14 can be reduced, the slider 10 can be further reduced in size and weight.

[Second Embodiment]

Next, a second embodiment of the slider for slide fastener according to the present invention will be described with reference to FIG. 12 to FIG. 15. The same reference numerals and symbols will be used in the drawings in order to designate some components when they are the same as or like to those of the first embodiment, and descriptions of those components will be omitted or simplified.

Figure 12:
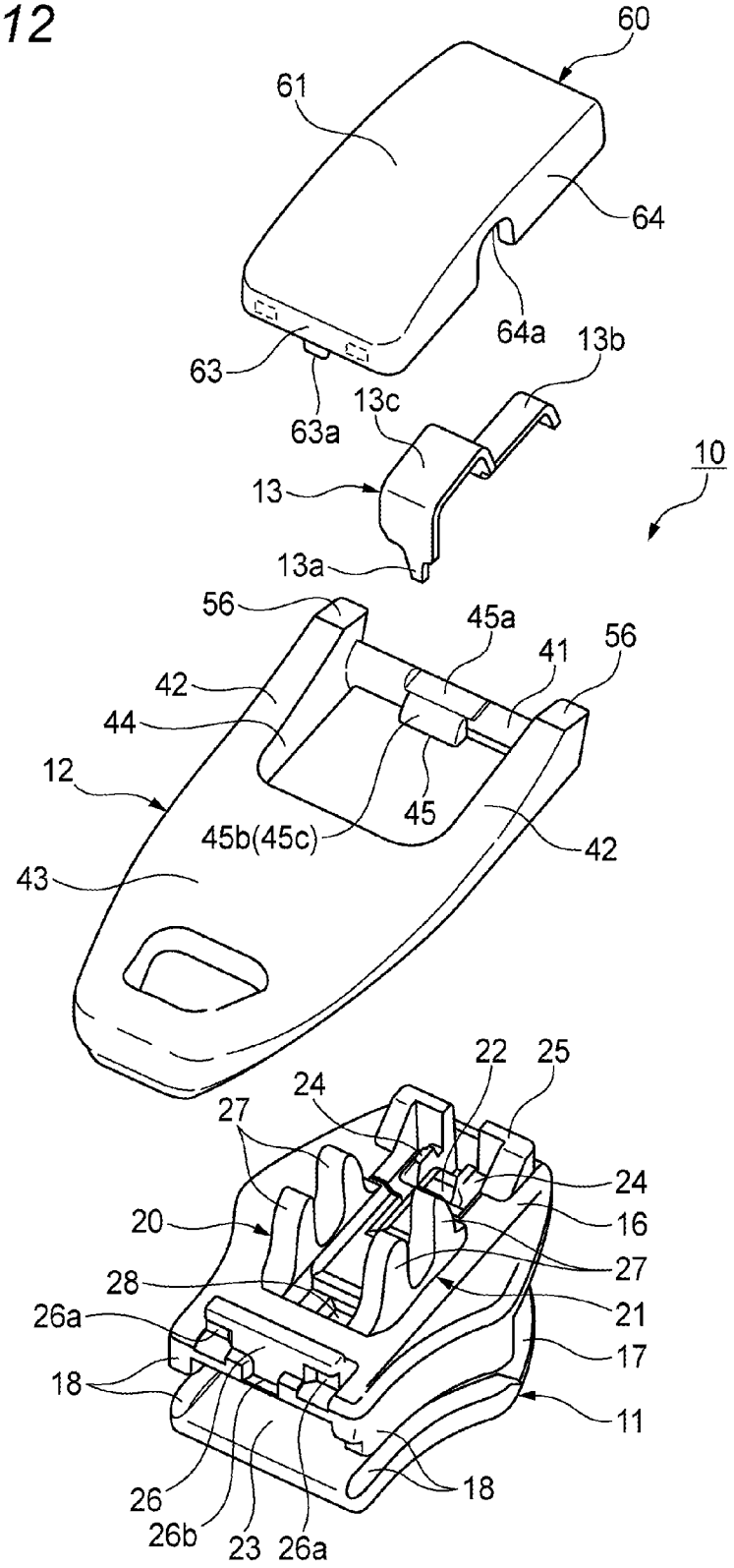
FIG. 12 is an exploded perspective view illustrating a second embodiment of the slider for slide fastener according to the present invention.
Figure 13:
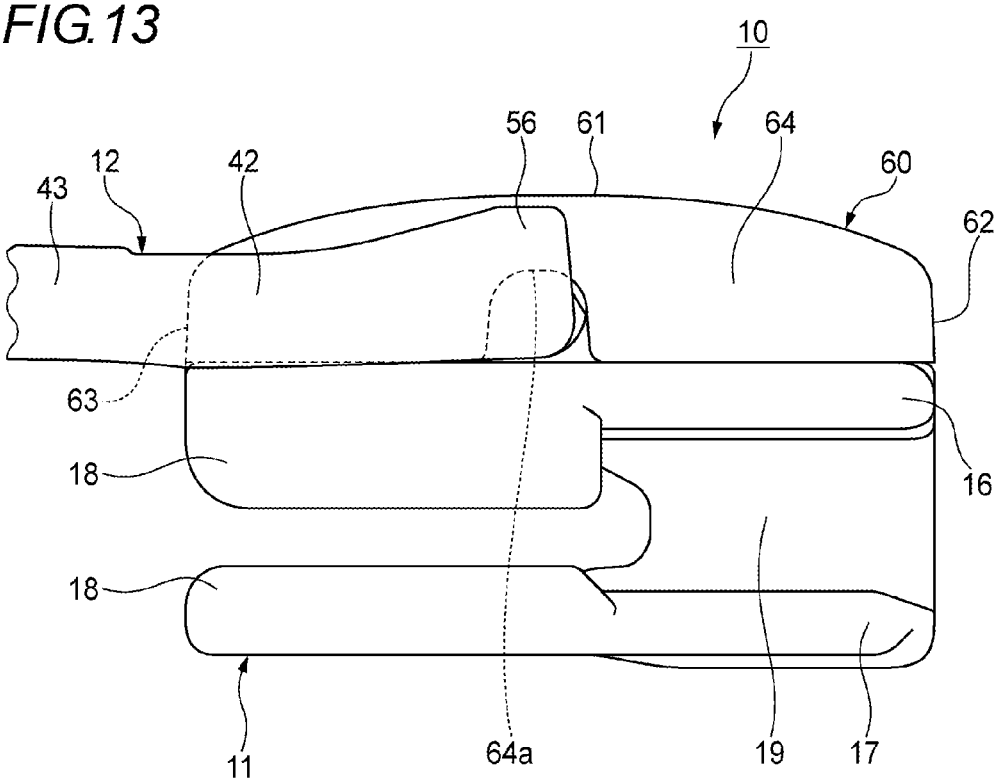
FIG. 13 is a side view of the slider for slide fastener shown in FIG. 12 when the pull-tab is in the laid-down state.

According to this embodiment, as shown in FIG. 12 and FIG. 13, pull-tab-side restraining portions 56 which are protrusions having substantially trapezoidal shape when viewed from the side are respectively formed on the upper surfaces of the front end portions of the right and left connecting rods 42 of the pull-tab 12. The front surfaces of the pull-tab-side restraining portions 56 which extend substantially vertically are formed so as to continue to the front end portions of the connecting rods 42. The pull-tab-side restraining portions 56 constitute a restraining part together with the upper surface of the upper blade 16 of the slider main body 11. The pull-tab 12 is prevented from rotating excessively as the pull-tab-side restraining portions 56 abut to the upper surface of the upper blade 16 (see FIG. 15).

According to this embodiment, a cover body 60 shown in FIG. 12 is used in place of the cover body 14 of the first embodiment. The cover body 60 has a shape produced by omitting the right and left shoulder portions 33 from the cover body 14 of the first embodiment, and covers the first and second pull-tab attachment posts 20 and 21 and the spring part 13.

The cover body 60 has a top plate 61 which is formed into rectangular shape when viewed from above and extends in the front and rear direction, a front plate 62 which extends downward from the front edge of the top plate 61, a rear plate 63 which extends downward from the rear edge of the top plate 61, and a pair of right and left side plates 64 which extend downward from both side edges of the top plate 61.

Figure 14:
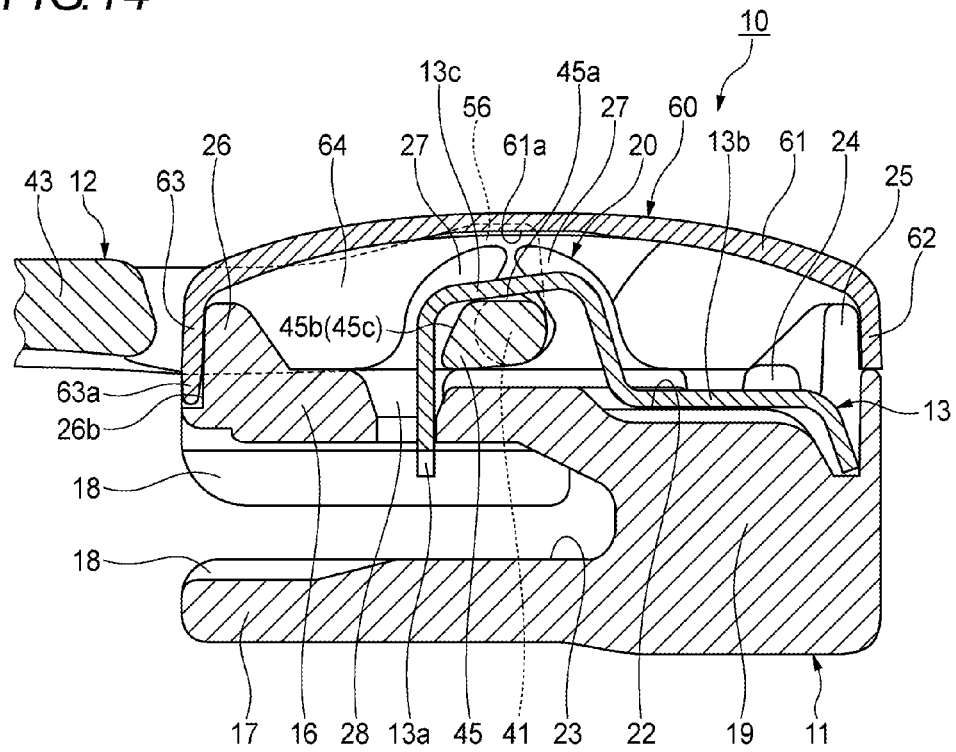
FIG. 14 is a longitudinal cross-sectional view of the slider for slide fastener shown in FIG. 13.
Figure 15:
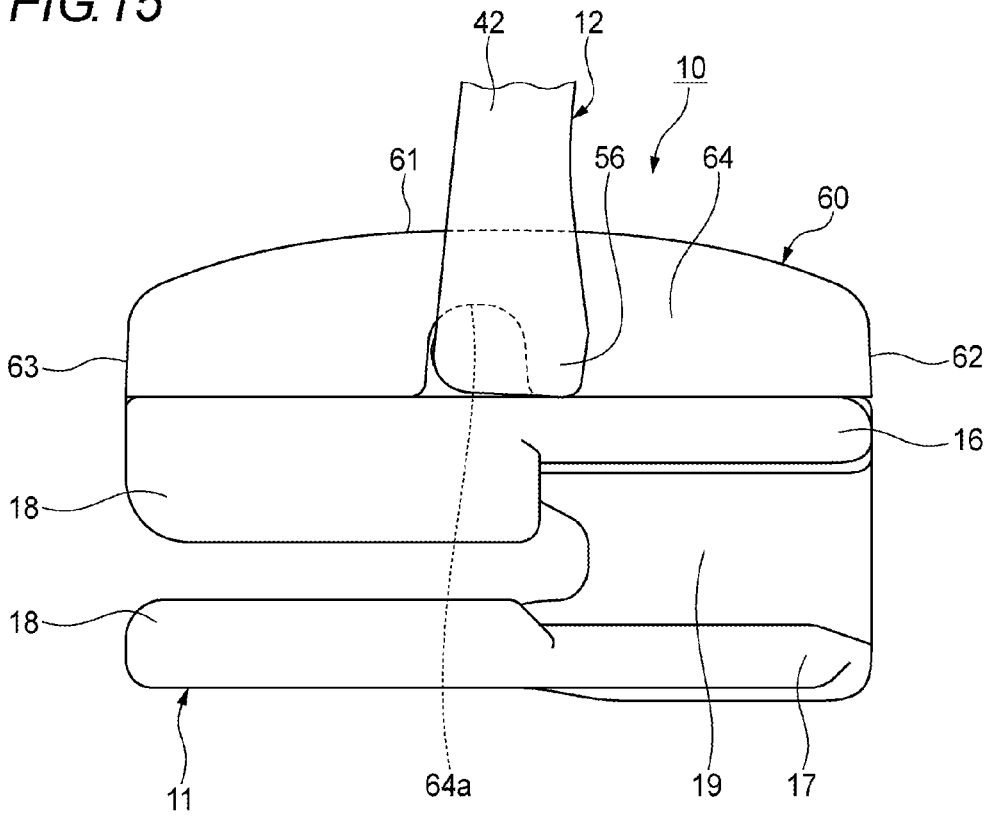
FIG. 15 is a side view of the slider for slide fastener shown in FIG. 12 when the pull-tab is in the erected state.

As shown in FIG. 12 and FIG. 14, a protrusion 63*a* which extends downward is formed at the central portion of the lower edge of the rear plate 63 in the right and left direction. The protrusion 63*a* is engaged with the recess 26*b* of the rear fixing post 26. In addition, middle portions of the right and left side plates 62 are respectively formed with penetration holes 64*a* through which the shaft portion 41 of the pull-tab 12 can penetrate. An inner surface of the top plate 61 is formed with a recess 61*a* into which the spring part 13 which is moved up by the cam portion 45 of the pull-tab 12 is retracted. With this configuration, the cover body 60 can be made as thin as possible.

The cover body 60 is fixed to the upper blade 16 by putting the cover body 60 over the front fixing post 25 and the rear fixing post 26 of the upper blade 16, crimping the front plate 62 to the right and left crimping recesses 25*a* of the front fixing post 25, and crimping the rear plate 63*b* in the right and left crimping recesses 26*a* of the rear fixing post 26. The other configurations, operations and effects are the same as those of the first embodiment.

In addition, the slider for slide fastener according to the present invention can be properly changed in design without departing from the technical concept of the present invention.

For instance, although the cam portion of the pull-tab has been disclosed as being formed in a part of the shaft portion in the foregoing embodiments, the present invention is not limited thereto, and the cam portion can be formed in the entire shaft portion.

DESCRIPTION OF REFERENCE NUMERALS

10 Slider for Slide Fastener
11 Slider Main Body
12 Pull-Tab
13 Spring Part
3*a* Locking Claw
14 Cover Body
16 Upper Blade
17 Lower Blade
19 Guide Post
20 First Pull-Tab Attachment Post
21 Second Pull-Tab Attachment Post
25 Front Fixing Post
26 Rear Fixing Post
31 Wide-Width Portion
31*a* Front Top Plate
31*b* Front Plate
31*c* Front Side Plate
31*d* Side Rear Plate
32 Narrow-Width Portion
32*e* Insert Hole
33 Shoulder Portion
34 Cover Body-Side Restraining Portion
41 Shaft Portion
42 Connecting Rod
43 Operating Portion
45 Cam Portion
45*a* Flat Surface
45*b* Inclined Surface
45*c* Cam Surface
46 Pull-Tab-Side Restraining Portion (Protrusion)
56 Pull-Tab-Side Restraining Portion (Protrusion)
SP Start Point
EP End Point

The invention claimed is:

1. A slider for a slide fastener comprising:

a slider main body having an upper blade, a lower blade, a guide post which connects the upper blade to the lower blade, and first and second pull-tab attachment posts which are erected on an upper surface of the upper blade, the slider main body configured to engage and disengage a pair of fastener elements;

a pull-tab attached to the first and second pull-tab attachment posts;

a spring part disposed between the first and second pull-tab attachment posts, the spring part having a locking claw at one end thereof; and a cover body immovably fixed to the upper blade of the slider main body, the cover body covering the first and second pull-tab attachment posts and the spring part, wherein the pull-tab has a shaft portion, a pair of connecting rods which are connected to the shaft portion, and an operating portion which is connected to the pair of connecting rods, wherein the shaft portion is provided with a cam portion, and when the pull-tab is rotated from a laid-down state where the pull-tab is laid down toward one side of the slider main body to an erected state where the pull-tab is moved up from the laid-down state and is erected on the slider main body, the pull-tab is urged with the cam portion in a direction in which the pull-tab returns to the laid-down state by an elastic force of the spring part, wherein the slider further comprises a restraining part configured to prevent the pull-tab from rotating further from the erected state and prevent the pull-tab from being laid down toward the other side of the slider main body, wherein the restraining part includes:

a pull-tab-side restraining portion formed in the pull-tab; and a cover-body-side restraining portion formed in the cover body, wherein the pull-tab-side restraining portion is configured to abut the cover body-side restraining portion so as to prevent the pull-tab from rotating further from the erected state, wherein the cover body is comprised of a top plate, side plates, a front plate and a rear plate, wherein the cover body has a wide-width portion disposed at a front end portion of the cover body and a narrow-width portion extending rearward from the wide-width portion, where a distance between a pair of side plates in the wide-width portion is greater than a distance between a pair of side plates in the narrow-width portion, wherein the cover body-side restraining portion is formed in a shoulder portion of the wide-width portion, which extends outward beyond the narrow-width portion in a width direction, and wherein the pull-tab-side restraining portion is a protrusion provided on an upper surface of one of the connecting rods.

2. The slider according to claim 1, wherein a contour forming a front end portion of the cover body at least at a side of the guide post has a same shape as a contour forming a front end portion of the upper blade.

3. The slider according to claim 1, wherein the top plate includes a front top plate in the wide-width portion which extends beyond the narrow-width portion in a right and left direction, the front plate extends downward from a front edge of the front top plate, the pair of side plates in the wide-width portion includes a pair of right and left front side plates which extend downward from both side edges of the front top plate, and side rear plates extend outward beyond the narrow-width portion in the width direction and respectively extend from rear edges of the front top plate, and wherein the shoulder portion is formed on the side rear plates.

4. The slider according to claim 1, wherein the pair of side plates in the narrow-width portion are formed with a penetration hole through which the shaft portion of the pull-tab is penetratable, and wherein when the pull-tab is in the laid-down state, positions of at least upper surfaces of the connecting rods of the pull-tab are at a height equal to or higher than an upper end of the shaft portion of the pull-tab and are at a height equal to or lower than an upper surface of the cover body.

5. The slider according to claim 1, wherein the cover body-side restraining portion is an inclined surface provided on the shoulder portion of the cover body and extending from a front end portion towards a rear end portion of the slider main body.

6. The slider according to claim 1, wherein the restraining part prevents the pull-tab from rotating such that a contact position between the spring part and the cam portion is within a range from a start point to an end point of a cam surface of the cam portion.

7. The slider according to claim 6, wherein the cam portion has a protrusion which protrudes toward the operating portion beyond the shaft portion which has a central axis, wherein the protrusion has an inclined surface which is inclined downward from an upper surface side to a lower surface side of the pull-tab, and wherein the cam surface is within a range of the inclined surface.

8. The slider according to claim 7, wherein the cam portion has a flat surface formed at an upper surface side of the pull-tab, and wherein only a portion of the flat surface at a side of the cam surface is elastically urged by the spring part.

* * * * *

UNITED STATES PATENT AND TRADEMARK OFFICE

CERTIFICATE OF CORRECTION

PATENT NO. : 9,271,548 B2
APPLICATION NO. : 14/126970
DATED : March 1, 2016
INVENTOR(S) : Keiichi Keyaki et al.

It is certified that error appears in the above-identified patent and that said Letters Patent is hereby corrected as shown below:

In the Specification

In column 3, line 11, delete "penetratable," and insert -- penetrable, --, therefor.

In column 6, line 38, delete "penetratable." and insert -- penetrable. --, therefor.

In column 6, line 44, delete "sholder" and insert -- shoulder --, therefor.

In the Claims

In column 13, line 28, in claim 4, delete "penetratable," and insert -- penetrable, --, therefor.

Signed and Sealed this
Twenty-sixth Day of July, 2016

Michelle K. Lee

Michelle K. Lee
*Director of the United States Patent and Trademark Office*